US008312915B2

(12) United States Patent
Anderson et al.

(10) Patent No.: US 8,312,915 B2
(45) **Date of Patent: *Nov. 20, 2012**

(54) METHOD FOR CASTING COMPOSITE INGOT

(75) Inventors: Mark Douglas Anderson, Green Acres, WA (US); Kenneth Takeo Kubo, Post Falls, ID (US); Todd F. Bischoff, Veradale, WA (US); Wayne J. Fenton, Spokane, WA (US); Eric W. Reeves, Post Falls, ID (US); Brent Spendlove, Liberty Lake, WA (US); Robert Bruce Wagstaff, Green Acres, WA (US)

(73) Assignee: Novelis Inc., Toronto, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/807,739

(22) Filed: Sep. 13, 2010

(65) Prior Publication Data

US 2011/0005704 A1 Jan. 13, 2011

Related U.S. Application Data

(60) Division of application No. 12/291,820, filed on Nov. 13, 2008, now Pat. No. 7,819,170, which is a continuation of application No. 10/875,978, filed on Jun. 23, 2004, now Pat. No. 7,472,740.

(60) Provisional application No. 60/482,229, filed on Jun. 24, 2003.

(51) Int. Cl.
*B22D 11/00* (2006.01)

(52) U.S. Cl. ..... 164/419; 164/461

(58) Field of Classification Search ..... 164/419, 164/461

See application file for complete search history.

(56) References Cited

U.S. PATENT DOCUMENTS 3,206,808 A * 9/1965 Robinson ..... 164/461
3,353,934 A 11/1967 Robinson
3,421,569 A 1/1969 Neumann (Continued)

FOREIGN PATENT DOCUMENTS

CA 2132881 6/1995

(Continued)

OTHER PUBLICATIONS

G.J.Binczewski et al., "Simultaneus Casting of Alloy Composities," Light metals 1972, Proceedings of Sessions, 101st AIME Meeting, San Francisco, CA, pp. 465-481.

(Continued)

*Primary Examiner* — Kevin P Kerns
(74) *Attorney, Agent, or Firm* — Cooper & Dunham LLP

(57) ABSTRACT

An apparatus is described for the casting of a composite metal ingot having two or more separately formed layers of one or more alloys. An open ended annular mould is provided having a divider wall dividing a feed end of the mould into at least two separate feed chambers. For each pair of adjacent feed chambers, a first alloy stream is fed through one of the pair of feed chambers into the mould and a second alloy stream is fed through another of the feed chambers. A self-supporting surface is generated on the surface of the first alloy stream and the second alloy stream is contacted with the first stream. By carefully selecting conditions and positions where the alloy streams meet, a composite metal ingot is formed in which the alloy layers are mutually attached with a substantially continuous metallurgical bond.

9 Claims, 12 Drawing Sheets

U.S. PATENT DOCUMENTS

| | | | | |
|---|---|---|---|---|
| 3,911,996 | A | 10/1975 | Veillette | |
| 4,449,568 | A | 5/1984 | Narasimham | |
| 4,498,521 | A | 2/1985 | Takeda et al. | |
| 4,567,936 | A | 2/1986 | Binczewski | |
| 4,598,763 | A | 7/1986 | Wagstaff et al. | |
| 4,828,015 | A | 5/1989 | Takeuchi et al. | |
| 5,526,870 | A | 6/1996 | Odegard et al. | |
| 5,947,184 | A | 9/1999 | Steen et al. | |
| 6,158,498 | A | 12/2000 | Wagstaff | |
| 6,224,992 | B1 | 5/2001 | Delbeke et al. | |
| 6,260,602 | B1 | 7/2001 | Wagstaff | |
| 6,848,233 | B1 | 2/2005 | Haszler et al. | |
| 7,472,740 | B2 | 1/2009 | Anderson et al. | |
| 7,819,170 | B2 * | 10/2010 | Anderson et al. | 164/461 |
| 7,975,752 | B2 * | 7/2011 | Wagstaff | 164/461 |
| 8,096,344 | B2 * | 1/2012 | Wagstaff et al. | 164/461 |
| 2002/0192493 | A1 | 12/2002 | Magnusen et al. | |
| 2003/0062143 | A1 | 4/2003 | Haszler et al. | |
| 2003/0079856 | A1 * | 5/2003 | Kilmer et al. | 164/461 |
| 2005/0011630 | A1 | 1/2005 | Anderson et al. | |
| 2006/0185816 | A1 | 8/2006 | Anderson et al. | |
| 2007/0215312 | A1 | 9/2007 | Gallerneault | |
| 2007/0215313 | A1 | 9/2007 | Wagstaff | |
| 2008/0008903 | A1 | 1/2008 | Bull et al. | |
| 2008/0202720 | A1 * | 8/2008 | Wagstaff | 164/127 |
| 2009/0056904 | A1 | 3/2009 | Wagstaff et al. | |
| 2009/0145569 | A1 | 6/2009 | Anderson et al. | |
| 2010/0032122 | A1 | 2/2010 | Gallerneault | |

FOREIGN PATENT DOCUMENTS

| | | | |
|---|---|---|---|
| CN | 1229703 | A | 9/1999 |
| DE | 740 827 | | 10/1943 |
| DE | 844 806 | | 7/1952 |
| DE | 44 20 697 | | 12/1995 |
| EP | 0 189 313 | | 7/1986 |
| EP | 0 219 581 | | 4/1987 |
| EP | 0 265 235 | A2 | 4/1988 |
| EP | 0 636 440 | | 2/1995 |
| EP | 0 796 683 | A2 | 9/1997 |
| FR | 2 835 455 | | 8/2003 |
| GB | 856 424 | | 12/1960 |
| GB | 1 174 764 | | 12/1969 |
| GB | 1184764 | | 3/1970 |
| GB | 1 266 570 | | 3/1972 |
| GB | 2 003 556 | | 3/1979 |
| GB | 2 204 518 | | 11/1988 |
| JP | 62-104652 | A | 5/1987 |
| JP | 08-300121 | A | 11/1996 |
| SU | 451496 | | 1/1975 |
| SU | 1 447 544 | A1 | 12/1988 |
| WO | WO 99/20418 | A1 | 4/1999 |
| WO | WO 03/006697 | | 1/2003 |
| WO | WO 03/035305 | | 5/2003 |
| WO | WO 2006/053701 | A2 | 5/2006 |

OTHER PUBLICATIONS

Patent Abstracts of Japan, vol. 0041, No. 08 (M-024), Aug. 5, 1980, JP 55 068156 A, "Production of Slab for Clad Steel Plate in Continuous Casting Method".

Database WPI Week 198940, Derwent Pub'ns. Ltd., 291528, XP002301665, Kolpakov et al., "Method of Continuous Casting of Bimetallic Ingots," abstract.

Patent Abstracts of Japan, vol. 008, No. 174(M-316), Aug. 10, 1984, JP 59 066962A, Milsubishi Jukogyo KK, Apr. 16, 1984, Abstract, Figs. 1-5.

Patent Abstracts of Japan, vol. 1996, No. 10, Oct. 31, 1996, JP 08 164469 A, Nikko Kinzoku KK et al., Jun. 25, 1996, Abstract, Figs. 1-3.

European Patent Office, Communication of Notice of Opposition to European Patent No. 1 638 715, Sep. 29, 2008.

Hydro Aluminum Deutschland GmbH, Einspruch gegen das europaische Patent 1 638 715, Sep. 19, 2008.

Patent Abst. of Japan, JP 08 300121A , "Device for Controlling Molten Metal Surface in Continuous Casting Machine and Method Therefor", Nov. 19, 1996, B22D 11/16, Hitachi.

Japanese Patent OfFIce, Preliminary Notice of Rejection (Dec. 1, 2009, Japanese patent application No. 2006-515605.

L. Anberg et al., Solidification Characteristics of Aluminum Alloys, 1996, pp. 7-11, vol. 3: Dendrite Coherency, American Foundrymen's Soc'y, Inc.

U.S. Appl. No. 12/807,740, filed Sep. 13, 2010, Anderson et al.

Canadian Intellectual Property Office, Official Action for Canadian Application No. 2,671,916, Aug. 11, 2011.

* cited by examiner

METHOD FOR CASTING COMPOSITE INGOT

CROSS-REFERENCE TO RELATED APPLICATIONS

This application is a division of U.S. application Ser. No. 12/291,820 filed Nov. 13, 2008, now U.S. Pat. No. 7,819,170, which is a continuation of U.S. application Ser. No. 10/875,978 filed Jun. 23, 2004, now U.S. Pat. No. 7,472,740, which claims the benefit of U.S. provisional application No. 60/482,229, filed Jun. 24, 2003. The disclosures of all these prior applications are incorporated herein by this reference.

FIELD OF THE INVENTION

This invention relates to a method and apparatus for casting composite metal ingots, as well as novel composite metal ingots thus obtained.

BACKGROUND OF THE INVENTION

For many years metal ingots, particularly aluminum or aluminum alloy ingots, have been produced by a semi-continuous casting process known as direct chill casting. In this procedure molten metal has been poured into the top of an open ended mould and a coolant, typically water, has been applied directly to the solidifying surface of the metal as it emerges from the mould.

Such a system is commonly used to produce large rectangular-section ingots for the production of rolled products, e.g. aluminum alloy sheet products. There is a large market for composite ingots consisting of two or more layers of different alloys. Such ingots are used to produce, after rolling, clad sheet for various applications such as brazing sheet, aircraft plate and other applications where it is desired that the properties of the surface be different from that of the core.

The conventional approach to such clad sheet has been to hot roll slabs of different alloys together to "pin" the two together, then to continue rolling to produce the finished product. This has a disadvantage in that the interface between the slabs is generally not metallurgically clean and bonding of the layers can be a problem.

There has also been an interest in casting layered ingots to produce a composite ingot ready for rolling. This has typically been carried out using direct chill (DC) casting, either by simultaneous solidification of two alloy streams or sequential solidification where one metal is solidified before being contacted by a second molten metal. A number of such methods are described in the literature that have met with varying degrees of success.

In Binczewski, U.S. Pat. No. 4,567,936, issued Feb. 4, 1986, a method is described for producing a composite ingot by DC casting where an outer layer of higher solidus temperature is cast about an inner layer with a lower solidus temperature. The disclosure states that the outer layer must be "fully solid and sound" by the time the lower solidus temperature alloy comes in contact with it.

Keller, German Patent 844 806, published Jul. 24, 1952 describes a single mould for casting a layered structure where an inner core is cast in advance of the outer layer. In this procedure, the outer layer is fully solidified before the inner alloy contacts it.

In Robinson, U.S. Pat. No. 3,353,934, issued Nov. 21, 1967 a casting system is described where an internal partition is placed within the mould cavity to substantially separate areas of different alloy compositions. The end of the baffle is designed so that it terminates in the "mushy zone" just above the solidified portion of the ingot. Within the "mushy zone" alloy is free to mix under the end of the baffle to form a bond between the layers. However, the method is not controllable in the sense that the baffle used is "passive" and the casting depends on control of the sump location—which is indirectly controlled by the cooling system.

In Matzner, German patent DE 44 20 697, published Dec. 21, 1995 a casting system is described using a similar internal partition to Robinson, in which the baffle sump position is controlled to allow for liquid phase mixing of the interface zone to create a continuous concentration gradient across the interface.

In Robertson et al, British patent GB 1,174,764, published 21 Dec. 1965, a moveable baffle is provided to divide up a common casting sump and allow casting of two dissimilar metals. The baffle is moveable to allow in one limit the metals to completely intermix and in the other limit to cast two separate strands.

In Kilmore et al., WO Publication 2003/035305, published May 1, 2003 a casting system is described using a barrier material in the form of a thin sheet between two different alloy layers. The thin sheet has a sufficiently high melting point that it remains intact during casting, and is incorporated into the final product.

Takeuchi et al., U.S. Pat. No. 4,828,015, issued May 9, 1989 describes a method of casting two liquid alloys in a single mould by creating a partition in the liquid zone by means of a magnetic field and feeding the two zones with separate alloys. The alloy that is fed to the upper part of the zone thereby forms a shell around the metal fed to the lower portion.

Veillette, U.S. Pat. No. 3,911,996, describes a mould having an outer flexible wall for adjusting the shape of the ingot during casting.

Steen et al., U.S. Pat. No. 5,947,184, describes a mould similar to Veillette but permitting more shape control.

Takeda et al., U.S. Pat. No. 4,498,521 describes a metal level control system using a float on the surface of the metal to measure metal level and feedback to the metal flow control.

Odegard et al., U.S. Pat. No. 5,526,870, describes a metal level control system using a remote sensing (radar) probe.

Wagstaff, U.S. Pat. No. 6,260,602, describes a mould having a variably tapered wall to control the external shape of an ingot.

It is an object of the present invention to produce a composite metal ingot consisting of two or more layers having an improved metallurgical bond between adjoining layers.

It is further object of the present invention to provide a means for controlling the interface temperature where two or more layers join in a composition ingot to improve the metallurgical bond between adjoining layers.

It is further object of the present invention to provide a means for controlling the interface shape where two or more alloys are combined in a composite metal ingot.

It is a further object of the present invention to provide a sensitive method for controlling the metal level in an ingot mould that is particularly useful in confined spaces.

SUMMARY OF THE INVENTION

One embodiment of the present invention is a method for the casting of a composite metal ingot comprising at least two layers formed of one or more alloys compositions. The method comprises providing an open ended annular mould having a feed end and an exit end wherein molten metal is added at the feed end and a solidified ingot is extracted from the exit end. Divider walls are used to divide the feed end into at least two separate feed chambers, the divider walls terminating above the exit end of the mould, and where each feed chamber is adjacent at least one other feed chamber. For each pair of adjacent feed chambers a first stream of a first alloy is fed to one of the pair of feed chambers to form a pool of metal in the first chamber and a second stream of a second alloy is fed through the second of the pair of feed chambers to form a pool of metal in the second chamber. The first metal pool contacts the divider wall between the pair of chambers to cool the first pool so as to form a self-supporting surface adjacent the divider wall. The second metal pool is then brought into contact with the first pool so that the second pool first contacts the self-supporting surface of the first pool at a point where the temperature of the self-supporting surface is between the solidus and liquidus temperatures of the first alloy. The two alloy pools are thereby joined as two layers and cooled to form a composite ingot.

Preferably the second alloy initially contacts the self-supporting surface of the first alloy when the temperature of the second alloy is above the liquidus temperature of the second alloy. The first and second alloys may have the same alloy composition or may have different alloy compositions.

Preferably the upper surface of the second alloy contacts the self-supporting surface of the first pool at a point where the temperature of the self-supporting surface is between the solidus and liquidus temperatures of the first alloy.

In this embodiment of the invention the self-supporting surface may be generated by cooling the first alloy pool such that the surface temperature at the point where the second alloy first contacts the self-supporting surface is between the liquidus and solidus temperature.

Another embodiment of the present invention comprises a method for the casting of a composite metal ingot comprising at least two layers formed of one or more alloys compositions. This method comprises providing an open ended annular mould having a feed end and an exit end wherein molten metal is added at the feed end and a solidified ingot is extracted from the exit end. Divider walls are used to divide the feed end into at least two separate feed chambers, the divider walls terminating above the exit end of the mould, and where each feed chamber is adjacent at least one other feed chamber. For each pair of adjacent feed chambers a first stream of a first alloy is fed to one of the pair of feed chambers to form a pool of metal in the first chamber and a second stream of a second alloy is fed through the second of the pair of feed chambers to form a pool of metal in the second chamber. The first metal pool contacts the divider wall between the pair of chambers to cool the first pool so as to form a self-supporting surface adjacent the divider wall. The second metal pool is then brought into contact with the first pool so that the second pool first contacts the self-supporting surface of the first pool at a point where the temperature of the self-supporting surface is below the solidus temperature of the first alloy to form an interface between the two alloys. The interface is then reheated to a temperature between the solidus and liquidus temperature of the first alloy so that the two alloy pools are thereby joined as two layers and cooled to form a composite ingot.

In this embodiment the reheating is preferably achieved by allowing the latent heat within the first or second alloy pools to reheat the surface.

Preferably the second alloy initially contacts the self-supporting surface of the first alloy when the temperature of the second alloy is above the liquidus temperature of the second alloy. The first and second alloys may have the same alloy composition or may have different alloy compositions.

Preferably the upper surface of the second alloy contacts the self-supporting surface of the first pool at a point where the temperature of the self-supporting surface is between the solidus and liquidus temperatures of the first alloy.

The self-supporting surface may also have an oxide layer formed on it. It is sufficiently strong to support the splaying forces normally causing the metal to spread out when unconfined. These splaying forces include the forces created by the metallostatic head of the first stream, and expansion of the surface in the case where cooling extends below the solidus followed by re heating the surface. By bringing the liquid second alloy into first contact with the first alloy while the first alloy is still in the semi-solid state or, and in the alternate embodiment, by ensuring that the interface between the alloys is reheated to a semi-solid state, a distinct but joining interface layer is formed between the two alloys. Furthermore, the fact that the interface between the second alloy layer and the first alloy is thereby formed before the first alloy layer has developed a rigid shell means that stresses created by the direct application of coolant to the exterior surface of the ingot are better controlled in the finished product, which is particularly advantageous when casting crack prone alloys.

The result of the present invention is that the interface between the first and second alloy is maintained, over a short length of emerging ingot, at a temperature between the solidus and liquidus temperature of the first alloy. In one particular embodiment, the second alloy is fed into the mould so that the upper surface of the second alloy in the mould is in contact with the surface of the first alloy where the surface temperature is between the solidus and liquidus temperature and thus an interface having met this requirement is formed. In an alternate embodiment, the interface is reheated to a temperature between the solidus and liquidus temperature shortly after the upper surface of the second alloy contacts the self-supporting surface of the first alloy. Preferably the second alloy is above its liquidus temperature when it first contacts the surface of the first alloy. When this is done, the interface integrity is maintained but at the same time, certain alloy components are sufficiently mobile across the interface that metallurgical bonding is facilitated.

If the second alloy is contacted where the temperature of the surface of the first alloy is sufficiently below the solidus (for example after a significant solid shell has formed), and there is insufficient latent heat to reheat the interface to a temperature between the solidus and liquidus temperatures of the first alloy, then the mobility of alloy components is very limited and a poor metallurgical bond is formed. This can cause layer separation during subsequent processing.

If the self-supporting surface is not formed on the first alloy prior to the second alloy contacting the first alloy, then the alloys are free to mix and a diffuse layer or alloy concentration gradient is formed at the interface, making the interface less distinct.

It is particularly preferred that the upper surface of the second alloy be maintained a position below the bottom edge of the divider wall. If the upper surface of the second alloy in the mould lies above the point of contact with the surface of the first alloy, for example, above the bottom edge of the divider wall, then there is a danger that the second alloy can disrupt the self supporting surface of the first alloy or even completely re-melt the surface because of excess latent heat. If this happens, there may be excessive mixing of alloys at the interface, or in some cases runout and failure of the cast. If the second alloy contacts the divider wall particularly far above the bottom edge, it may even be prematurely cooled to a point where the contact with the self-supporting surface of the first alloy no longer forms a strong metallurgical bond. In certain cases it may however be advantageous to maintain the upper surface of the second alloy close to the bottom edge of the divider wall but slightly above the bottom edge so that the divider wall can act as an oxide skimmer to prevent oxides from the surface of the second layer from being incorporated in the interface between the two layers. This is particularly advantageous where the second alloy is prone to oxidation. In any case the upper surface position must be carefully controlled to avoid the problems noted above, and should not lie more than about 3 mm above the bottom end of the divider.

In all of the preceding embodiments it is particularly advantageous to contact the second alloy to the first at a temperature between the solidus and coherency temperature of the first alloy or to reheat the interface between the two to a temperature between the solidus and coherency temperature of the first alloy. The coherency point, and the temperature (between the solidus and liquidus temperature) at which it occurs is an intermediate stage in the solidification of the molten metal. As dendrites grow in size in a cooling molten metal and start to impinge upon one another, a continuous solid network builds up throughout the alloy volume. The point at which there is a sudden increase in the torque force needed to shear the solid network is known as the "coherency point". The description of coherency point and its determination can be found in Solidification Characteristics of Aluminum Alloys Volume 3 Dendrite Coherency Pg 210.

In another embodiment of the invention, there is provided an apparatus for casting metal comprising an open ended annular mould having a feed end and an exit end and a bottom block that can fit within the exit end and is movable in a direction along the axis of the annular mould. The feed end of the mould is divided into at least two separate feed chambers, where each feed chamber is adjacent at least one other feed chamber and where the adjacent feed chambers are separated by a temperature controlled divider wall that can add or remove heat. The divider wall ends above the exit end of the mould. Each chamber includes a metal level control apparatus such that in adjacent pairs of chambers the metal level in one chamber can be maintained at a position above the lower end of the divider wall between the chambers and in the other chamber can be maintained at a different position from the level in the first chamber.

Preferably the level in the other chamber is maintained at a position below the lower end of the divider wall.

The divider wall is designed so that the heat extracted or added is calibrated so as to create a self-supporting surface on metal in the first chamber adjacent the divider wall and to control the temperature of the self-supporting surface of the metal in the first chamber to lie between the solidus and liquidus temperature at a point where the upper surface of the metal in the second chamber can be maintained.

The temperature of the self-supporting layer can be carefully controlled by removing heat from the divider wall by a temperature control fluid being passed through a portion of the divider wall or being brought into contact with the divider wall at its upper end to control the temperature of the self-supporting layer.

A further embodiment of the invention is a method for the casting of a composite metal ingot comprising at least two different alloys, which comprises providing an open ended annular mould having a feed end and an exit end and means for dividing the feed end into at least two separate, feed chambers, where each feed chamber is adjacent at least one other feed chamber. For each pair of adjacent feed chambers, a first stream of a first alloy is fed through one of the adjacent feed chambers into said mould, a second stream of a second alloy is fed through another of the adjacent feed chambers. A temperature controlling divider wall is provided between the adjacent feed chambers such that the point on the interface where the first and second alloy initially contact each other is maintained at a temperature between the solidus and liquidus temperature of the first alloy by means of the temperature controlling divider wall whereby the alloy streams are joined as two layers. The joined alloy layers are cooled to form a composite ingot.

The second alloy is preferably brought into contact with the first alloy immediately below the bottom of the divider wall without first contacting the divider wall. In any event, the second alloy should contact the first alloy no less than about 2 mm below the bottom edge of the divider wall but not greater than 20 mm and preferably about 4 to 6 mm below the bottom edge of the divider wall.

If the second alloy contacts the divider wall before contacting the first alloy, it may be prematurely cooled to a point where the contact with the self-supporting surface of the first alloy no longer forms a strong metallurgical bond. Even if the liquidus temperature of the second alloy is sufficiently low that this does not happen, the metallostatic head that would exist may cause the second alloy to feed up into the space between the first alloy and the divider wall and cause casting defects or failure. When the upper surface of the second alloy is desired to be above the bottom edge of the divider wall (e.g. to skim oxides) it must in all cases be carefully controlled and positioned as close as practical to the bottom edge of the divider wall to avoid these problems.

The divider wall between adjacent pairs of feed chambers may be tapered and the taper may vary along the length of the divider wall. The divider wall may further have a curvilinear shape. These features can be used to compensate for the different thermal and solidification properties of the alloys used in the chambers separated by the divider wall and thereby provide for control of the final interface geometry within the emerging ingot. The curvilinear shaped wall may also serve to form ingots with layers having specific geometries that can be rolled with less waste. The divider wall between adjacent pairs of feed chambers may be made flexible and may be adjusted to ensure that the interface between the two alloy layers in the final cast and rolled product is straight regardless of the alloys used and is straight even in the start-up section.

A further embodiment of the invention is an apparatus for casting of composite metal ingots, comprising an open ended annular mould having a feed end and an exit end and a bottom block that can fit inside the exit end and move along the axis of the mould. The feed end of the mould is divided into at least two separate feed chambers, where each feed chamber is adjacent at least one other feed chamber and where the adjacent feed chambers are separated by a divider wall. The divider wall is flexible, and a positioning device is attached to the divider wall so that the wall curvature in the plane of the mould can be varied by a predetermined amount during operation.

A further embodiment of the invention is a method for the casting of a composite metal ingot comprising at least two different alloys, which comprises providing an open ended annular mould having a feed end and an exit end and means for dividing the feed end into at least two separate, feed chambers, where each feed chamber is adjacent at least one other feed chamber. For adjacent pairs of the feed chambers, a first stream of a first alloy is fed through one of the adjacent feed chambers into the mould, and a second stream of a second alloy is fed through another of the adjacent feed chambers. A flexible divider wall is provided between adjacent feed chambers and the curvature of the flexible divider wall is adjusted during casting to control the shape of interface where the alloys are joined as two layers. The joined alloy layers are then cooled to form a composite ingot.

The metal feed requires careful level control and one such method is to provide a slow flow of gas, preferably inert, through a tube with an opening at a fixed point with respect to the body of the annular mould. The opening is immersed in use below the surface of the metal in the mould, the pressure of the gas is measured and the metallostatic head above the tube opening is thereby determined. The measured pressure can therefore be used to directly control the metal flow into the mould so as to maintain the upper surface of the metal at a constant level.

A further embodiment of the invention is a method of casting a metal ingot which comprises providing an open ended annular mould having a feed end and an exit end, and feeding a stream of molten metal into the feed end of said mould to create a metal pool within said mould having a surface. The end of a gas delivery tube is immersed into the metal pool from the feed end of mould tube at a predetermined position with respect to the mould body and an inert gas is bubbled through the gas delivery tube at a slow rate sufficient to keep the tube unfrozen. The pressure of the gas within the said tube is measured to determine the position of the molten metal surface with respect to the mould body.

A further embodiment of the invention is an apparatus for casting a metal ingot that comprises an open-ended annular mould having a feed end and an exit end and a bottom block that fits in the exit end and is movable along the axis of the mould. A metal flow control device is provided for controlling the rate at which metal can flow into the mould from an external source, and a metal level sensor is also provided comprising a gas delivery tube attached to a source of gas by means of a gas flow controller and having an open end positioned at a predefined location below the feed end of the mould, such that in use, the open end of the tube would normally lie below the metal level in the mould. A means is also provided for measuring the pressure of the gas in the gas delivery tube between the flow controller and the open end of the gas delivery tube, the measured pressure of the gas being adapted to control the metal flow control device so as to maintain the metal into which the open end of the gas delivery tube is placed at a predetermined level.

This method and apparatus for measuring metal level is particularly useful in measuring and controlling metal level in a confined space such as in some or all of the feed chambers in a multi-chamber mould design. It may be used in conjunction with other metal level control systems that use floats or similar surface position monitors, where for example, a gas tube is used in smaller feed chambers and a feed control system based on a float or similar device in the larger feed chambers.

In one preferred embodiment of the present invention there is provided a method for casting a composite ingot having two layer of different alloys, where one alloy forms a layer on the wider or "rolling" face of a rectangular cross-sectional ingot formed from another alloy. For this procedure there is provided an open ended annular mould having a feed end and an exit end and means for dividing the feed end into separate adjacent feed chambers separated by a temperature controlled divider wall. The first stream of a first alloy is fed though one of the feed chambers into the mould and a second stream of a second alloy is fed through another of the feed chambers, this second alloy having a lower liquidus temperature than the first alloy. The first alloy is cooled by the temperature controlled divider wall to form a self-supporting surface that extends below the lower end of the divider wall and the second alloy is contacted with the self-supporting surface of the first alloy at a location where the temperature of the self-supporting surface is maintained between the solidus and liquidus temperature of the first alloy, whereby the two alloy streams are joined as two layers. The joined alloy layers are then cooled to form a composite ingot.

In another preferred embodiment the two chambers are configured so that an outer chamber completely surrounds the inner chamber whereby an ingot is formed having a layer of one alloy completely surrounding a core of a second alloy.

A preferred embodiment includes two laterally spaced temperature controlled divider walls forming three feed chambers. Thus, there is a central feed chamber with a divider wall on each side and a pair of outer feed chambers on each side of the central feed chamber. A stream of the first alloy may be fed through the central feed chamber, with streams of the second alloy being fed into the two side chambers. Such an arrangement is typically used for providing two cladding layers on a central core material.

It is also possible to reverse the procedure such that streams of the first alloy are feed through the side chambers while a stream of the second alloy is fed through the central chamber. With this arrangement, casting is started in the side feed chambers with the second alloy being fed through the central chamber and contacting the pair of first alloys immediately below the divider walls.

The ingot cross-sectional shape may be any convenient shape (for example circular, square, rectangular or any other regular or irregular shape) and the cross-sectional shapes of individual layers may also vary within the ingot.

Another embodiment of the invention is a cast ingot product consisting of an elongated ingot comprising, in cross-section, two or more separate alloy layers of differing composition, wherein the interface between adjacent alloys layers is in the form of a substantially continuous metallurgical bond. This bond is characterized by the presence of dispersed particles of one or more intermetallic compositions of the first alloy in a region of the second alloy adjacent the interface. Generally in the present invention the first alloy is the one on which a self-supporting surface is first formed and the second alloy is brought into contact with this surface while the surface temperature is between the solidus and liquidus temperature of the first alloy, or the interface is subsequently reheated to a temperature between the solidus and liquidus temperature of the first alloy. The dispersed particles preferably are less than about 20 μm in diameter and are found in a region of up to about 200 μm from the interface.

The bond may be further characterized by the presence of plumes or exudates of one or more intermetallic compositions of the first alloy extending from the interface into the second alloy in the region adjacent the interface. This feature is particularly formed when the temperature of the self-supporting surface has not been reduced below the solidus temperature prior to contact with the second alloy.

The plumes or exudates preferably penetrate less than about 100 μm into the second alloy from the interface.

Where the intermetallic compositions of the first alloy are dispersed or exuded into the second alloy, there remains in the first alloy, adjacent to the interface between the first and second alloys, a layer which contains a reduced quantity of the intermetallic particles and which consequently can form a layer which is more noble than the first alloy and may impart corrosion resistance to the clad material. This layer is typically 4 to 8 mm thick.

This bond may be further characterized by the presence of a diffuse layer of alloy components of the first alloy in the second alloy layer adjacent the interface. This feature is particularly formed in instances where the surface of the first alloy is cooled below the solidus temperature of the first alloy and then the interface between first and second alloy is reheated to between the solidus and liquidus temperatures.

Although not wishing to be bound by any theory, it is believed that the presence of these features is caused by formation of segregates of intermetallic compounds of the first alloy at the self supporting surface formed on it with their subsequent dispersal or exudation into the second alloy after it contacts the surface. The exudation of intermetallic compounds is assisted by splaying forces present at the interface.

A further feature of the interface between layers formed by the methods of this invention is the presence of alloy components from the second alloy between the grain boundaries of the first alloy immediately adjacent the interface between the two alloys. It is believed that these arise when the second alloy (still generally above its liquidus temperature) comes in contact with the self-supporting surface of the first alloy (at a temperature between the solidus and liquidus temperature of the first alloy). Under these specific conditions, alloy component of the second alloy can diffuse a short distance (typically about 50 μm) along the still liquid grain boundaries, but not into the grains already formed at the surface of the first alloy. If the interface temperature in above the liquidus temperature of both alloys, general mixing of the alloys will occur, and the second alloy components will be found within the grains as well as grain boundaries. If the interface temperature is below the solidus temperature of the first alloy, there will be not opportunity for grain boundary diffusion to occur.

The specific interfacial features described are specific features caused by solid state diffusion, or diffusion or movement of elements along restricted liquid paths and do not affect the generally distinct nature of the overall interface.

Regardless how the interface is formed, the unique structure of the interface provides for a strong metallurgical bond at the interface and therefore makes the structure suitable for rolling to sheet without problems associated with delamination or interface contamination.

In yet a further embodiment of the invention, there is a composite metal ingot, comprising at least two layers of metal, wherein pairs of adjacent layers are formed by contacting the second metal layer to the surface of the first metal layer such that the when the second metal layer first contacts the surface of the first metal layer the surface of the first metal layer is at a temperature between its liquidus and solidus temperature and the temperature of the second metal layer is above its liquidus temperature. Preferably the two metal layers are composed of different alloys.

Similarly in yet a further embodiment of the invention, there is a composite metal ingot, comprising at least two layers of metal, wherein pairs of adjacent layers are formed by contacting the second metal layer to the surface of the first metal layer such that the when the second metal layer first contacts the surface of the first metal layer the surface of the first metal layer is at a temperature below its solidus temperature and the temperature of the second metal layer is above its liquidus temperature, and the interface formed between the two metal layers is subsequently reheated to a temperature between the solidus and liquidus temperature of the first alloy. Preferably the two metal layers are composed of different alloys.

In one preferred embodiment, the ingot is rectangular in cross section and comprises a core of the first alloy and at least one surface layer of the second layer, the surface layer being applied to the long side of the rectangular cross-section. This composite metal ingot is preferably hot and cold rolled to form a composite metal sheet.

In one particularly preferred embodiment, the alloy of the core is an aluminum-manganese alloy and the surface alloy is an aluminum-silicon alloy. Such composite ingot when hot and cold rolled to form a composite metal brazing sheet that may be subject to a brazing operation to make a corrosion resistant brazed structure.

In another particularly preferred embodiment, the alloy core is a scrap aluminum alloy and the surface alloy a pure aluminum alloy. Such composite ingots when hot and cold rolled to form composite metal sheet provide for inexpensive recycled products having improved properties of corrosion resistance, surface finishing capability, etc. In the present context a pure aluminum alloy is an aluminum alloy having a thermal conductivity greater than 190 watts/m/K and a solidification range of less than 50° C.

In yet another particularly preferred embodiment the alloy core is a high strength non-heat treatable alloy (such as an Al—Mg alloy) and the surface alloy is a brazeable alloy (such as an Al—Si alloy). Such composite ingots when hot and cold rolled to form composite metal sheet may be subject to a forming operation and used for automotive structures which can then be brazed or similarly joined.

In yet another particularly preferred embodiment the alloy core is a high strength heat treatable alloy (such as an 2xxx alloy) and the surface alloy is a pure aluminum alloy. Such composite ingots when hot and cold rolled form composite metal sheet suitable for aircraft structures. The pure alloy may be selected for corrosion resistance or surface finish and should preferably have a solidus temperature greater than the solidus temperature of the core alloy.

In yet another particularly preferred embodiment the alloy core is a medium strength heat treatable alloy (such as an Al—Mg—Si alloy) and the surface alloy is a pure aluminum alloy. Such composite ingots when hot and cold rolled form composite metal sheet suitable for automotive closures. The pure alloy may be selected for corrosion resistance or surface finish and should preferably have a solidus temperature greater than the solidus temperature of the core alloy.

In another preferred embodiment, the ingot is cylindrical in cross-section and comprises a core of the first alloy and a concentric surface layer of the second alloy. In yet another preferred embodiment, the ingot is rectangular or square in cross-section and comprises a core of the second alloy and a annular surface layer of the first alloy.

BRIEF DESCRIPTION OF THE DRAWINGS

In the drawings which illustrate certain preferred embodiments of this invention.

DESCRIPTION OF THE PREFERRED EMBODIMENTS

Figure 1:
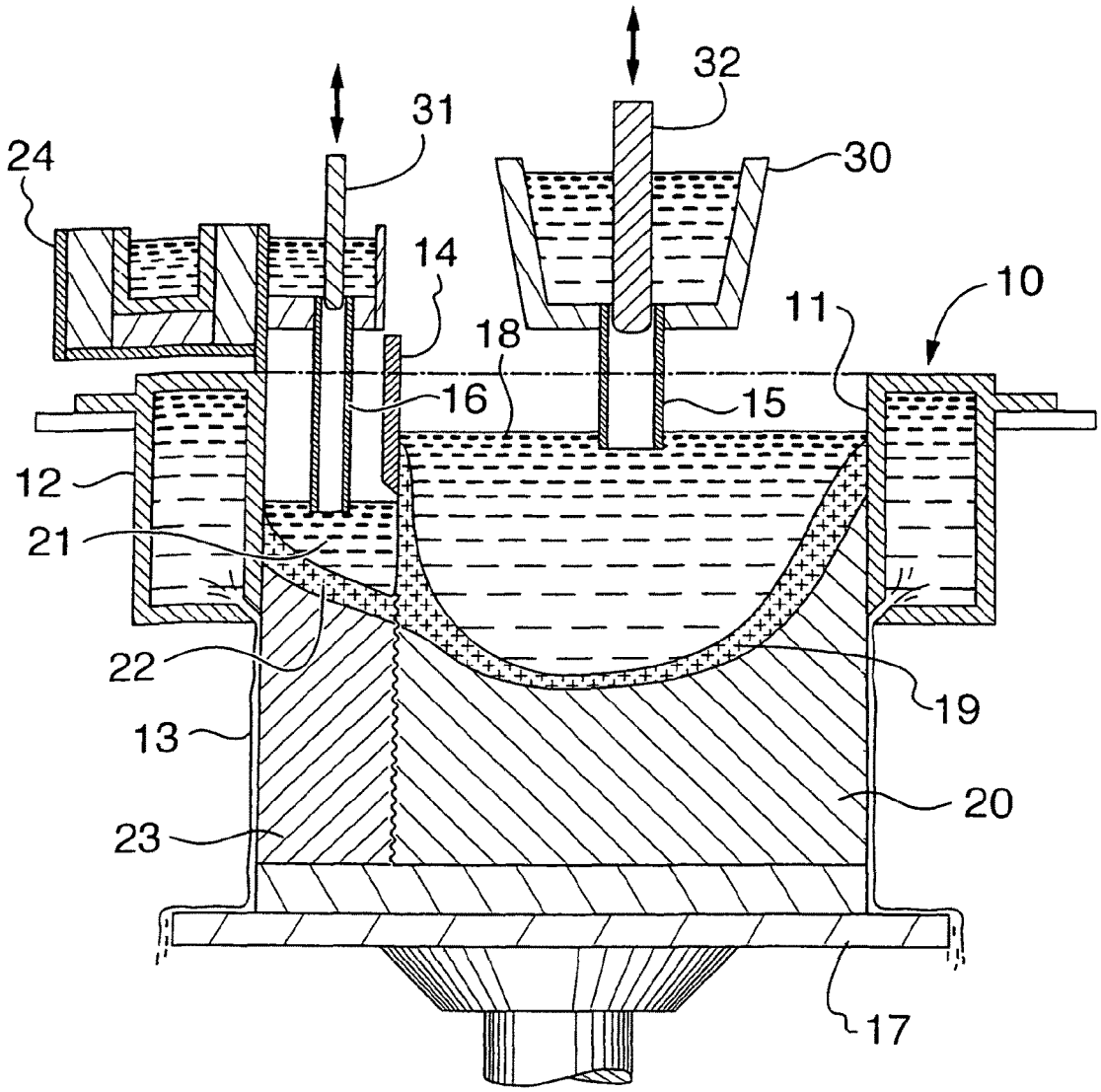
FIG. 1 is an elevation view in partial section showing a single divider wall.

With reference to FIG. 1, rectangular casting mould assembly 10 has mould walls 11 forming part of a water jacket 12 from which a stream of cooling water 13 is dispensed.

The feed portion of the mould is divided by a divider wall 14 into two feed chambers. A molten metal delivery trough 30 and delivery nozzle 15 equipped with an adjustable throttle 32 feeds a first alloy into one feed chamber and a second metal delivery trough 24 equipped with a side channel, delivery nozzle 16 and adjustable throttle 31 feeds a second alloy into a second feed chamber. The adjustable throttles 31, 32 are adjusted either manually or responsive to some control signal to adjust the flow of metal into the respective feed chambers. A vertically movable bottom block unit 17 supports the embryonic composite ingot being formed and fits into the outlet end of the mould prior to starting a cast and thereafter is lowered to allow the ingot to form.

Figure 2:
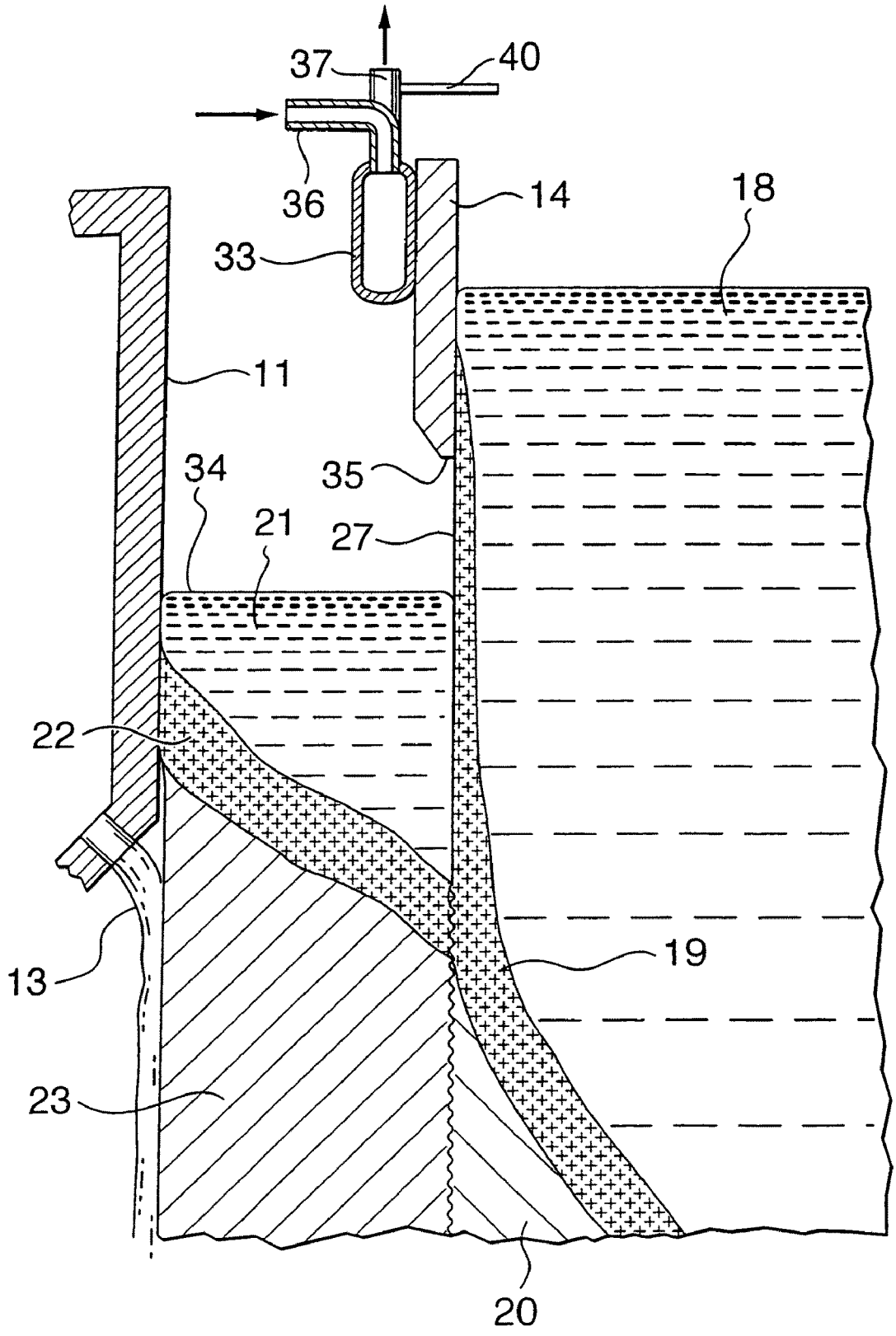
FIG. 2 is a schematic illustration of the contact between the alloys.

As more clearly shown with reference to FIG. 2, in the first feed chamber, the body of molten metal 18 gradually cools so as to form a self-supporting surface 27 adjacent the lower end of the divider wall and then forms a zone 19 that is between liquid and solid and is often referred as a mushy zone. Below this mushy or semi-solid zone is a solid metal alloy 20. Into the second feed chamber is fed a second alloy liquid flow 21 having a lower liquidus temperature than the first alloy 18. This metal also forms a mushy zone 22 and eventually a solid portion 23.

The self-supporting surface 27 typically undergoes a slight contraction as the metal detaches from the divider wall 14 then a slight expansion as the splaying forces caused, for example, by the metallostatic head of the metal 18 coming to bear. The self-supporting surface has sufficient strength to restrain such forces even though the temperature of the surface may be above the solidus temperature of the metal 18. An oxide layer on the surface can contribute to this balance of forces.

The temperature of the divider wall 14 is maintained at a predetermined target temperature by means of a temperature control fluid passing through a closed channel 33 having an inlet 36 and outlet 37 for delivery and removal of temperature control fluid that extracts heat from the divider wall so as to create a chilled interface which serves to control the temperature of the self supporting surface 27 below the lower end of the divider wall 35. The upper surface 34 of the metal 21 in the second chamber is then maintained at a position below the lower edge 35 of the divider wall 14 and at the same time the temperature of the self supporting surface 27 is maintained such that the surface 34 of the metal 21 contacts this self supporting surface 27 at a point where the temperature of the surface 27 lies between the solidus and liquidus temperature of the metal 18. Typically the surface 34 is controlled at a point slightly below the lower edge 35 of the divider wall 14, generally within about 2 to 20 mm from the lower edge. The interface layer thus formed between the two alloy streams at this point forms a very strong metallurgical bond between the two layers without excessive mixing of the alloys.

The coolant flow (and temperature) required to establish the temperature of the self-supporting surface 27 of metal 18 within the desired range is generally determined empirically by use of small thermocouples that are embedded in the surface 27 of the metal ingot as it forms and once established for a given composition and casting temperature for metal 18 (casting temperature being the temperature at which the metal 18 is delivered to the inlet end of the feed chamber) forms part of the casting practice for such an alloy. It has been found in particular that at a fixed coolant flow through the channel 33, the temperature of the coolant exiting the divider wall coolant channel measured at the outlet 37 correlates well with the temperature of the self supporting surface of the metal at predetermined locations below the bottom edge of the divider wall, and hence provides for a simple and effective means of controlling this critical temperature by providing a temperature measuring device such as a thermocouple or thermistor 40 in the outlet of the coolant channel.

Figure 3:
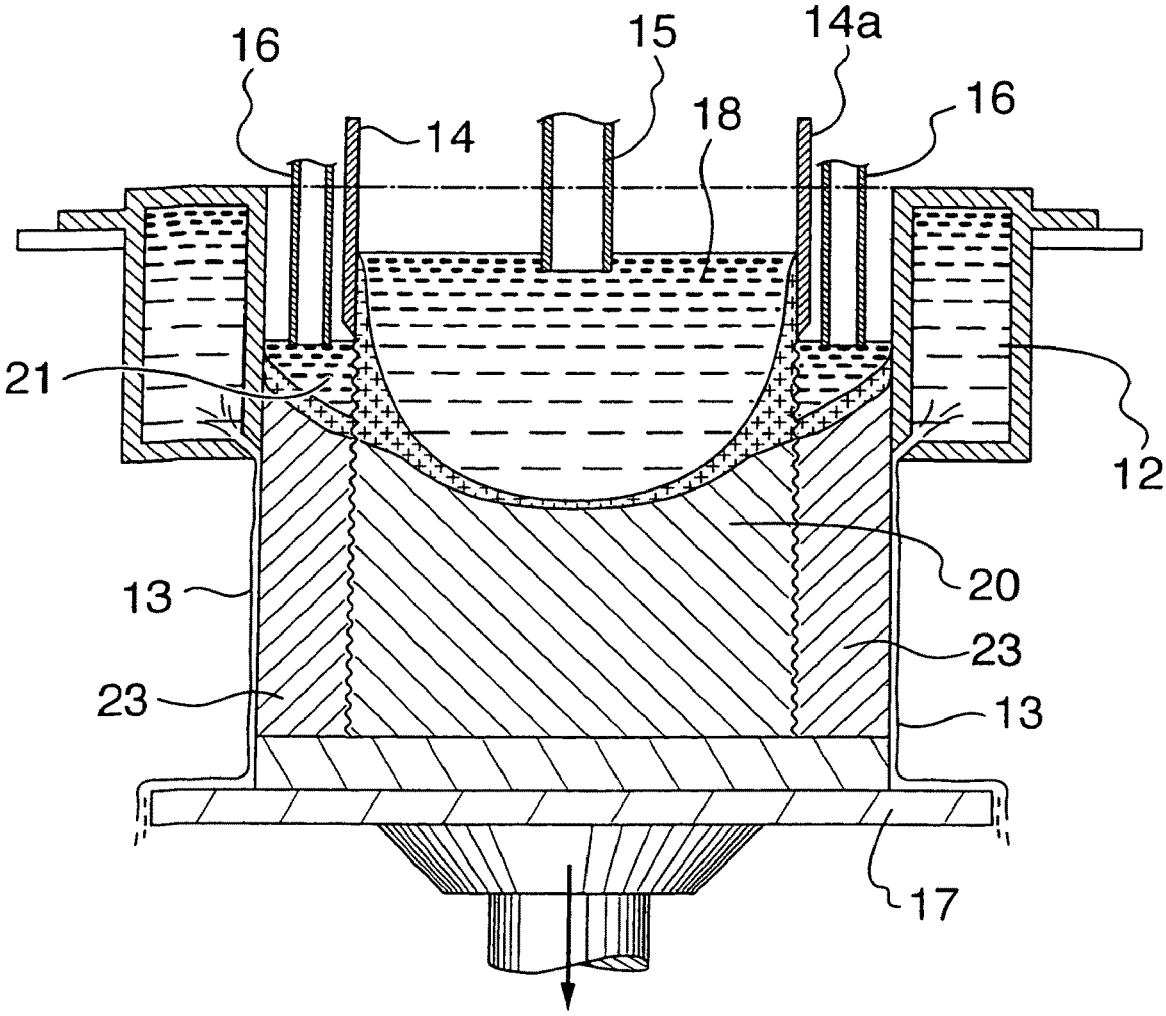
FIG. 3 is an elevation view in partial section similar to FIG. 1, but showing a pair of divider walls.

FIG. 3 is essentially the same mould as in FIG. 1, but in this case a pair of divider walls 14 and 14*a* are used dividing the mouth of the mould into three feed chambers. There is a central chamber for the first metal alloy and a pair of outer feed chambers for a second metal alloy. The outer feed chambers may be adapted for a second and third metal alloy, in which case the lower ends of the divider walls 14 and 14*a* may be positioned differently and the temperature control may differ for the two divider walls depending on the particular requirements for casting and creating strongly bonded interfaces between the first and second alloys and between the first and third alloys.

Figure 4:
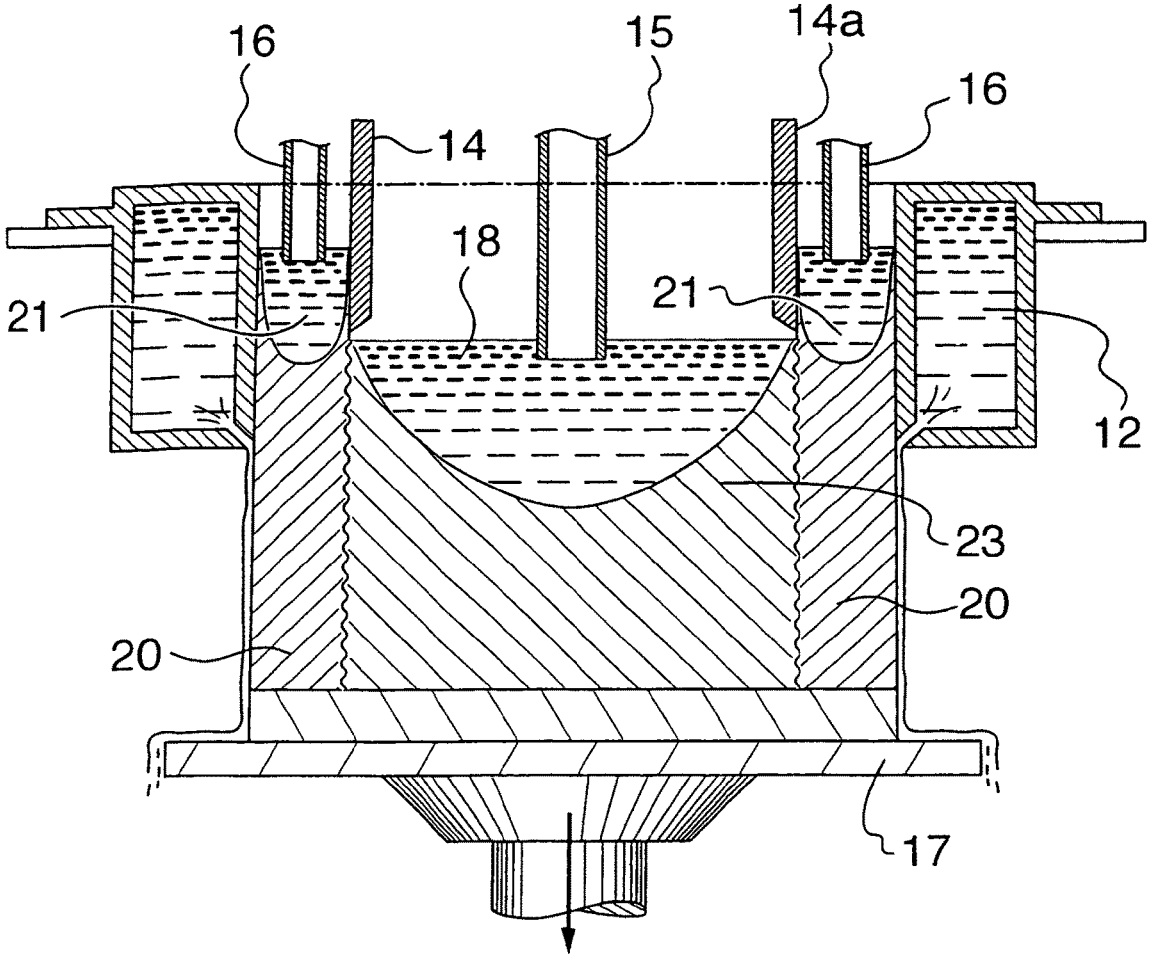
FIG. 4 is an elevation view in partial section similar to FIG. 3, but with the second alloy having a lower liquidus temperature than the first alloy being fed into the central chamber.

As shown in FIG. 4, it is also possible to reverse the alloys so that the first alloy streams are fed into the outer feed chambers and a second alloy stream is fed into the central feed chamber.

Figure 5A:
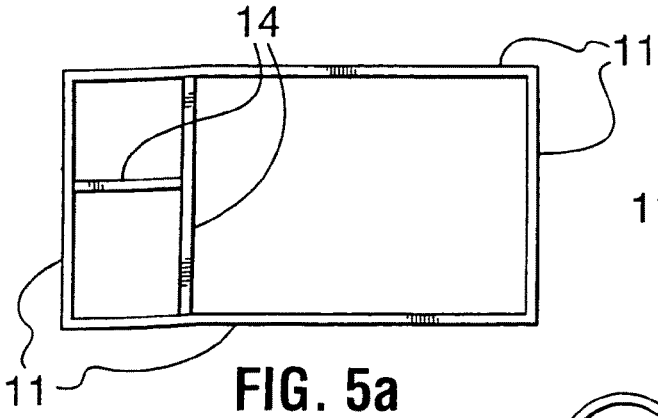
FIGS. 5*a*, 5*b* and 5*c* are plan views showing some alternative arrangements of feed chamber that may be used with the present invention.
Figure 5B:
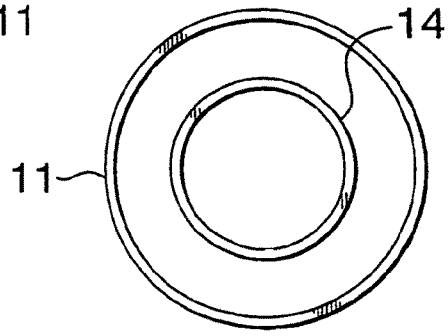
Figure 5C:
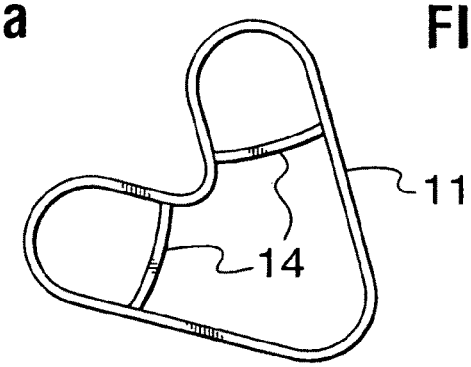

FIG. 5 shows several more complex chamber arrangements in plan view. In each of these arrangements there is an outer wall 11 shown for the mould and the inner divider walls 14 separating the individual chambers. Each divider wall 14 between adjacent chambers must be positioned and thermally controlled such that the conditions for casting described herein are maintained. This means that the divider walls may extend downwards from the inlet of the mould and terminate at different positions and may be controlled at different temperatures and the metal levels in each chamber may be controlled at different levels in accordance with the requirements of the casting practice.

Figure 6:
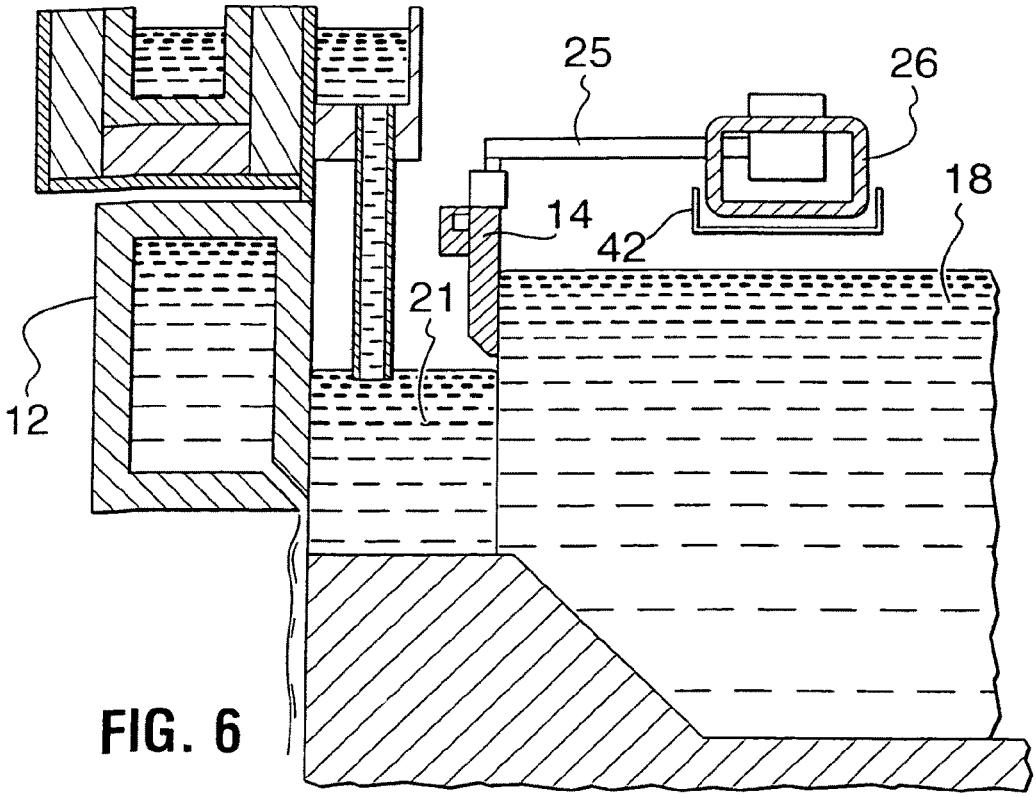
FIG. 6 is an enlarged view in partial section of a portion of FIG. 1 showing a curvature control system.
Figure 7:
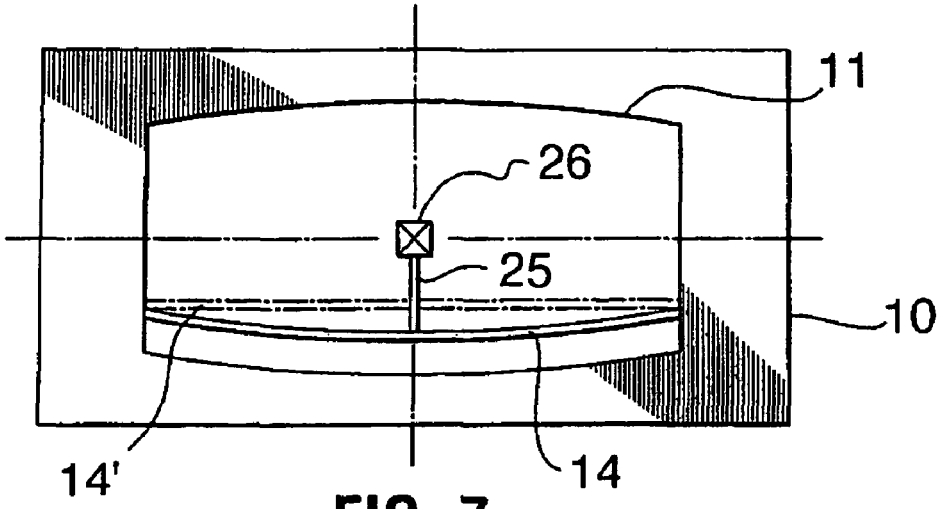
FIG. 7 is a plan view of a mould showing the effects of variable curvature of the divider wall.

It is advantageous to make the divider wall 14 flexible or capable of having a variable curvature in the plane of the mould as shown in FIGS. 6 and 7. The curvature is normally changed between the start-up position 14' and steady state position 14 so as to maintain a constant interface throughout the cast. This is achieved by means of an arm 25 attached at one end to the top of the divider wall 14 and driven in a horizontal direction by a linear actuator 26. If necessary the actuator is protected by a heat shield 42.

The thermal properties of alloys vary considerably and the amount and degree of variation in the curvature is predetermined based on the alloys selected for the various layers in the ingot. Generally these are determined empirically as part of a casting practice for a particular product.

Figure 8:
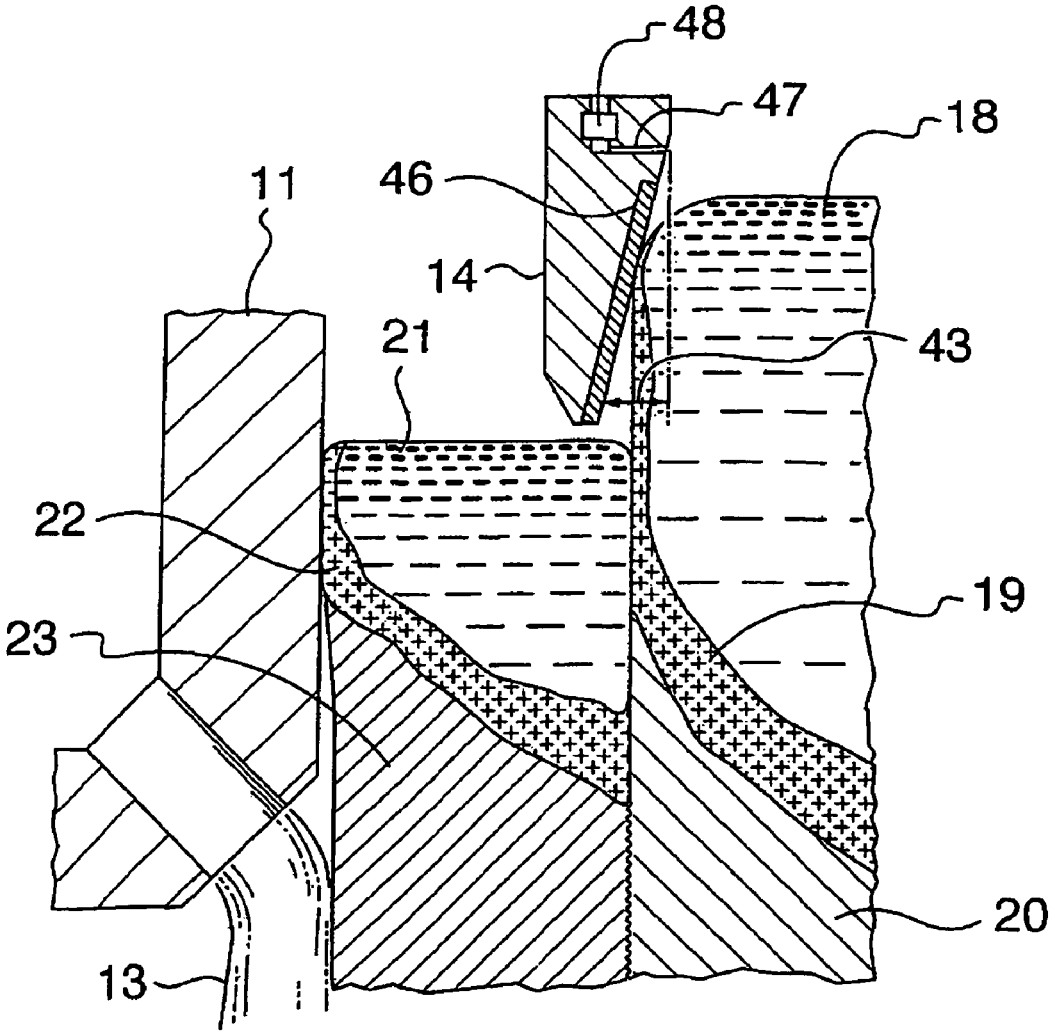
FIG. 8 is an enlarged view of a portion of FIG. 1 illustrating a tapered divider wall between alloys.

As shown in FIG. 8 the divider wall 14 may also be tapered 43 in the vertical direction on the side of the metal 18. This taper may vary along the length of the divider wall 14 to further control the shape of the interface between adjacent alloy layer. The taper may also be used on the outer wall 11 of the mould. This taper or shape can be established using principals, for example, as described in U.S. Pat. No. 6,260,602 (Wagstaff) and will again depend on the alloys selected for the adjacent layers.

The divider wall 14 is manufactured from metal (steel or aluminum for example) and may in part be manufactured from graphite, for example by using a graphite insert 46 on the tapered surface. Oil delivery channels 48 and grooves 47 may also be used to provide lubricants or parting substances. Of course inserts and oil delivery configurations may be used on the outer walls in manner known in the art.

Figure 9:
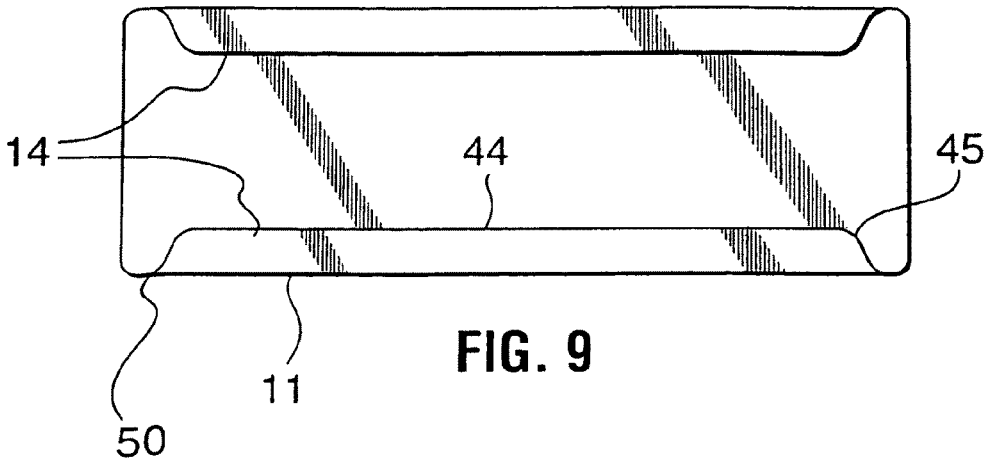
FIG. 9 is a plan view of a mould showing a particularly preferred configuration of a divider wall.

A particular preferred embodiment of divider wall is shown in FIG. 9. The divider wall 14 extends substantially parallel to the mould sidewall 11 along one or both long (rolling) faces of a rectangular cross section ingot. Near the ends of the long sides of the mould, the divider wall 14 has 90° curves 45 and is terminated at locations 50 on the long side wall 11, rather than extending fully to the short side walls. The clad ingot cast with such a divider wall can be rolled to better maintain the shape of the cladding over the width of the sheet than occurs in more conventional roll-cladding processes. The taper described in FIG. 8 may also be applied to this design, where for example, a high degree of taper may be used at curved surface 45 and a medium degree of taper on straight section 44.

Figure 10:
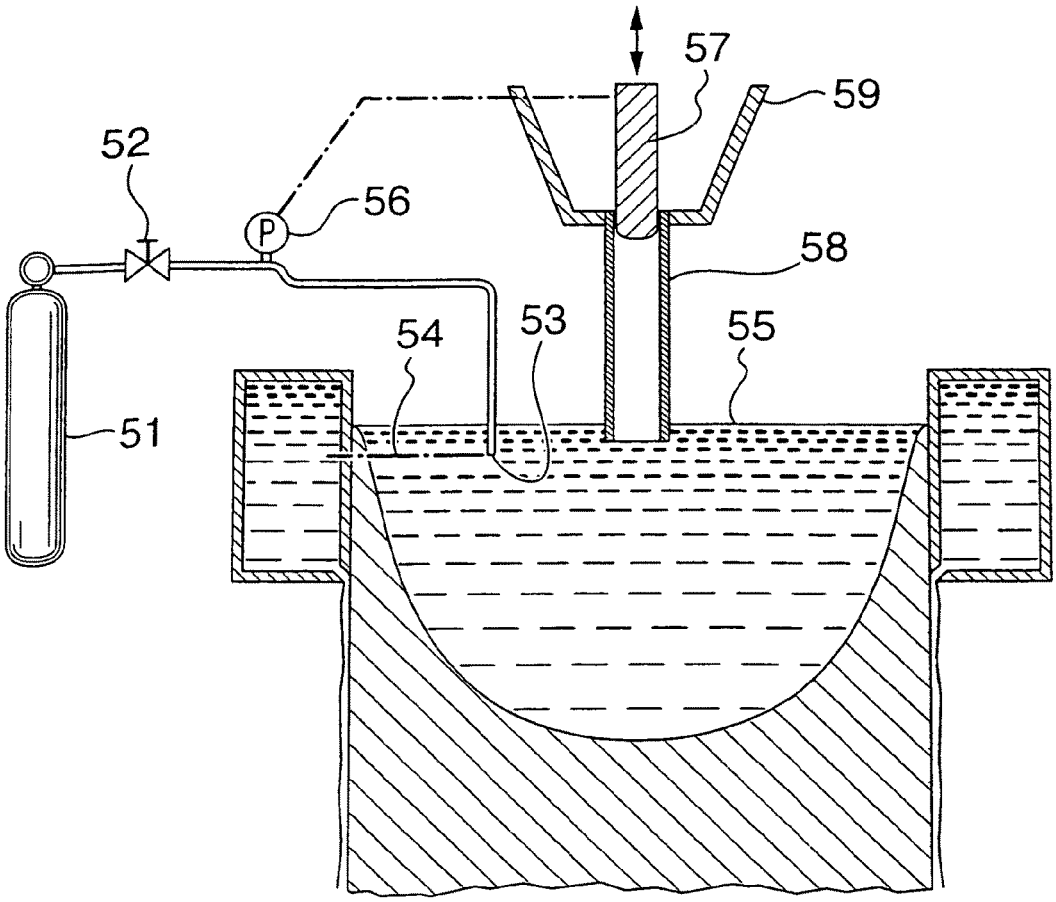
FIG. 10 is a schematic view showing the metal level control system of the present invention.

FIG. 10 shows a method of controlling the metal level in a casting mould which can be used in any casting mould, whether or not for casting layered ingots, but is particularly useful for controlling the metal level in confined spaces as may be encountered in some metal chambers in moulds for casting multiple layer ingots. A gas supply 51 (typically a cylinder of inert gas) is attached to a flow controller 52 that delivers a small flow of gas to a gas delivery tube with an open end 53 that is positioned at a reference location 54 within the mould. The inside diameter of the gas delivery tube at its exit is typically between 3 to 5 mm. The reference location is selected so as to be below the top surface of the metal 55 during a casting operation, and this reference location may vary depending on the requirements of the casting practice.

A pressure transducer 56 is attached to the gas delivery tube at a point between the flow controller and the open end so as to measure the backpressure of gas in the tube. This pressure transducer 56 in turn produces a signal that can be compared to a reference signal to control the flow of metal entering the chamber by means known to those skilled in the art. For example an adjustable refractory stopper 57 in a refractory tube 58 fed in turn from a metal delivery trough 59 may be used. In use, the gas flow is adjusted to a low level just sufficient to maintain the end of the gas delivery tube open. A piece of refractory fibre inserted in the open end of the gas delivery tube is used to dampen the pressure fluctuations caused by bubble formation. The measured pressure then determines the degree of immersion of the open end of the gas delivery tube below the surface of the metal in the chamber and hence the level of the metal surface with respect to the reference location and the flow rate of metal into the chamber is therefore controlled to maintain the metal surface at a predetermined position with respect to the reference location.

The flow controller and pressure transducer are devices that are commonly available devices. It is particularly preferred however that the flow controller be capable of reliable flow control in the range of 5 to 10 cc/minute of gas flow. A pressure transducer able to measure pressures to about 0.1 psi (0.689 kPa) provides a good measure of metal level control (to within 1 mm) in the present invention and the combination provides for good control even in view of slight fluctuations in the pressure causes by the slow bubbling through the open end of the gas delivery tube.

Figure 11:
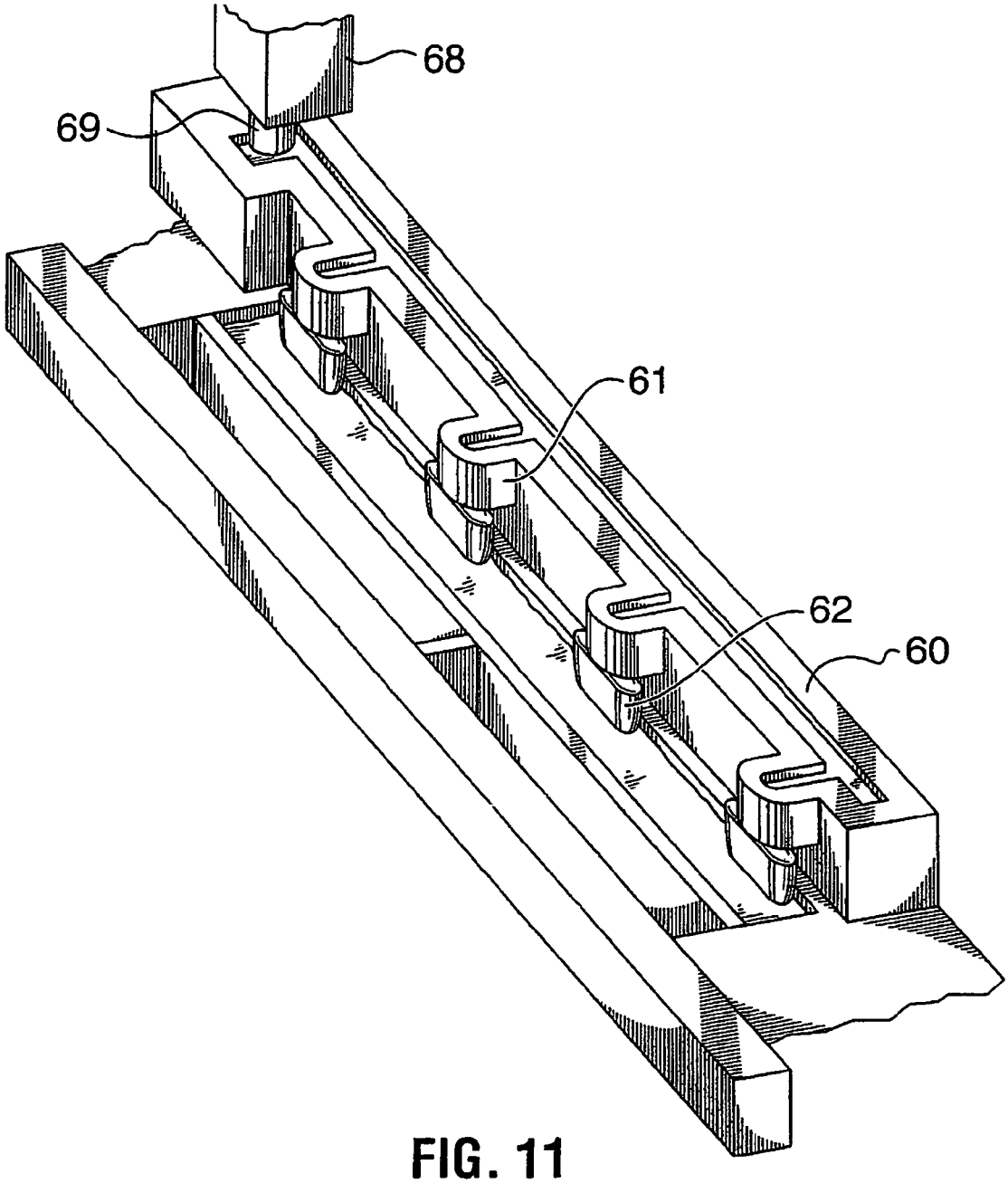
FIG. 11 is a perspective view of a feed system for one of the feed chambers of the present invention.

FIG. 11 shows a perspective view of a portion of the top of the mould of the present invention. A feed system for one of the metal chambers is shown, particularly suitable for feeding metal into a narrow feed chamber as may be used to produce a clad surface on an ingot. In this feed system, a channel 60 is provided adjacent the feed chamber having several small down spouts 61 connected to it which end below the surface of the metal. Distribution bags 62 made from refractory fabric by means known in the art are installed around the outlet of each down spout 61 to improve the uniformity of metal distribution and temperature. The channel in turn is fed from a trough 68 in which a single down spout 69 extends into the metal in the channel and in which is inserted a flow control stopper (not shown) of conventional design. The channel is positioned and leveled so that metal flows uniformly to all locations.

Figure 12:
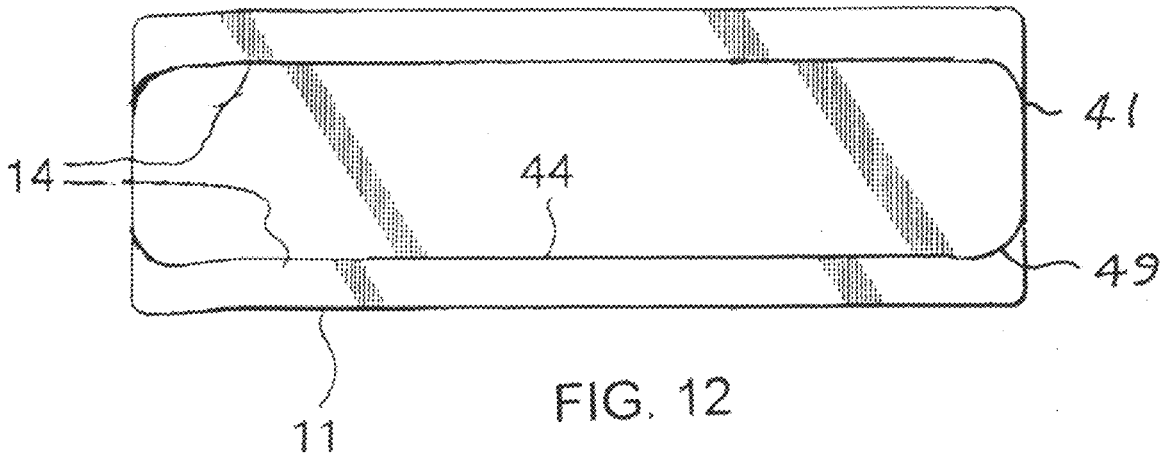
FIG. 12 is a plan view of a mould showing another preferred configuration of the divider wall.

FIG. 12 shows a further preferred arrangement of divider walls 14 for casting a rectangular cross-section ingot clad on two faces. The divider walls have a straight section 44 substantially parallel to the mould sidewall 11 along one or both long (rolling) faces of a rectangular cross section ingot. However, in this case each divider wall has curved end portions 49 which intersect the shorter end wall of the mould at locations 41. This is again useful in maintaining the shape of the cladding over the width of the sheet than occurs in more conventional roll-cladding processes. Whilst illustrated for cladding on two faces, it can equally well be used for cladding on a single face of the ingot.

Figure 13:
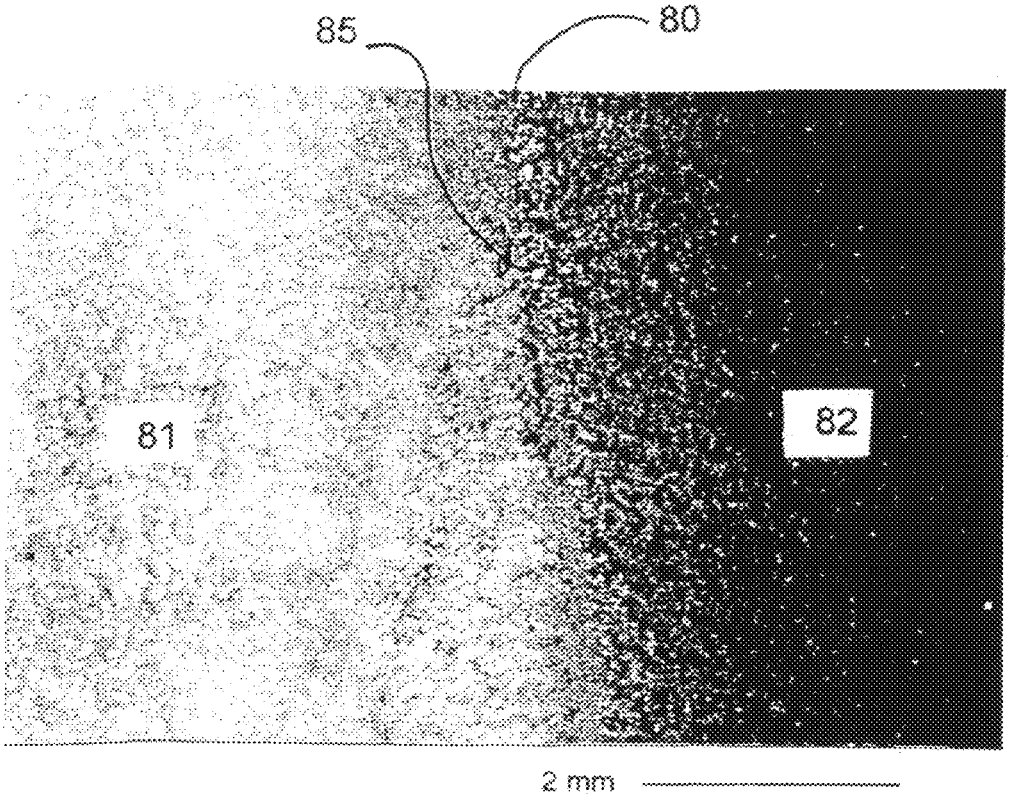
FIG. 13 is a microphotograph of a section through the joining face between a pair of adjacent alloys using the method of the present invention showing the formation of intermetallic particles in the opposite alloy.

FIG. 13 is a microphotograph at 15× magnification showing the interface 80 between an Al—Mn alloy 81 (X-904 containing 0.74% by weight Mn, 0.55% by weight Mg, 0.3% by weight Cu, 0.17% by weight, 0.07% by weight Si and the balance Al and inevitable impurities) and an Al—Si alloy 82 (AA4147 containing 12% by weight Si, 0.19% by weight Mg and the balance Al and inevitable impurities) cast under the conditions of the present invention. The Al—Mn alloy had a solidus temperature of 1190° F. (643° C.) and a liquidus temperature of 1215° F. (657° C.). The Al—Si alloy had a solidus temperature of 1070° F. (576° C.) and a liquidus temperature of 1080° F. (582° C.). The Al—Si alloy was fed into the casting mould such that the upper surface of the metal was maintained so that it contacted the Al—Mn alloy at a location where a self-supporting surface has been established on the Al—Mn alloy, but its temperature was between the solidus and liquidus temperatures of the Al—Mn alloy.

A clear interface is present on the sample indicating no general mixing of alloys, but in addition, particles of intermetallic compounds containing Mn 85 are visible in an approximately 200 μm band within the Al—Si alloy 82 adjacent the interface 80 between the Al—Mn and Al—Si alloys. The intermetallic compounds are mainly $MnAl_6$ and alpha-AlMn.

Figure 14:
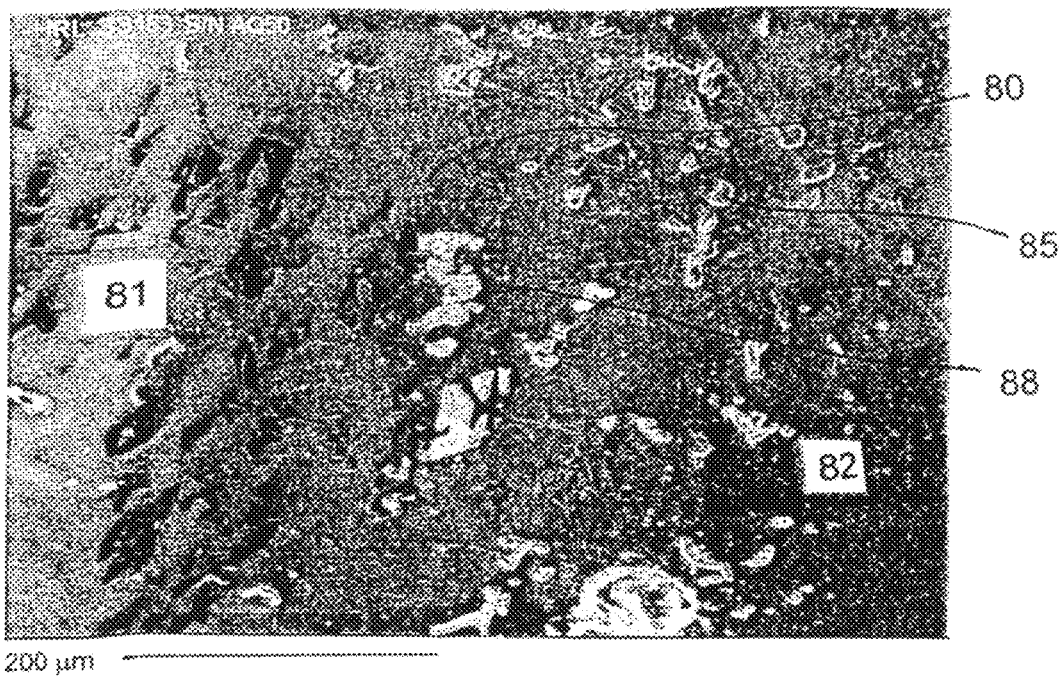
FIG. 14 is a microphotograph of a section through the same joining face as in FIG. 13 showing the formation of intermetallic plumes or exudates.

FIG. 14 is a microphotograph at 200× magnification showing the interface 80 of the same alloy combination as in FIG. 13 where the self-surface temperature was not allowed to fall below the solidus temperature of the Al—Mn alloy prior to the Al—Si alloy contacting it. A plume or exudate 88 is observed extending from the interface 80 into the Al—Si alloy 82 from the Al—Mn alloy 81 and the plume or exudate has a intermetallic composition containing Mn that is similar to the particles in FIG. 13. The plumes or exudates typically extend up to 100 μm into the neighbouring metal. The resulting bond between the alloys is a strong metallurgical bond. Particles of intermetallic compounds containing Mn 85 are also visible in this microphotograph and have a size typically up to 20 μm.

Figure 15:
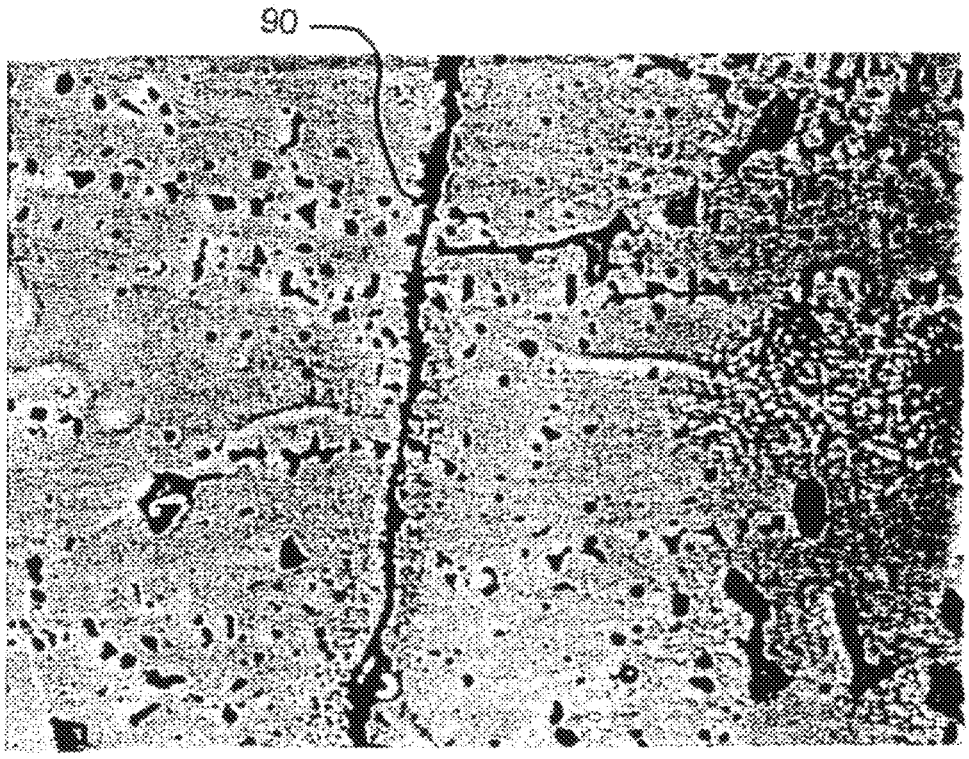
FIG. 15 is a microphotograph of a section through the joining face between a pair of adjacent alloys processed under conditions outside the scope of the present invention.

FIG. 15 is a microphotograph (at 300× magnification) showing the interface between an Al—Mn alloy (AA3003) and an Al—Si alloy (AA4147) but where the Al—Mn self-supporting surface was cooled more than about 5° C. below the solidus temperature of the Al—Mn alloy, at which point the upper surface of the Al—Si alloy contacted the self-supporting surface of the Al—Mn alloy. The bond line 90 between the alloys is clearly visible indicating that a poor metallurgical bond was thereby formed. There is also an absence of exudates or dispersed intermetallic compositions of the first alloy in the second alloy.

A variety of alloy combinations were cast in accordance with the process of the present invention. The conditions were adjusted so that the first alloy surface temperature was between its solidus and liquidus temperature at the the upper surface of the second alloy. In all cases, the alloys were cast into ingots 690 mm×1590 mm and 3 metres long and then processed by conventional preheating, hot rolling and cold rolling. The alloy combinations cast are given in Table 1 below. Using convention terminology, the "core" is the thicker supporting layer in a two alloy composite and the "cladding" is the surface functional layer. In the table, the First Alloy is the alloy cast first and the second alloy is the alloy brought into contact with the self-supporting surface of the first alloy.

TABLE 1

| | First Alloy | | | Second Alloy | | |
|---|---|---|---|---|---|---|
| Cast | Location and alloy | L-S Range (° C) | Casting temperature (° C) | Location and alloy | L-S range (° C) | Casting temperature (° C) |
| 051804 | Clad 0303 | 660-659 | 664-665 | Core 3104 | 654-629 | 675-678 |
| 030826 | Clad 1200 | 657-646 | 685-690 | Core 2124 | 638-502 | 688-690 |
| 031013 | Clad 0505 | 660-659 | 692-690 | Core 6082 | 645-563 | 680-684 |
| 030827 | Clad 1050 | 657-646 | 695-697 | Core 6111 | 650-560 | 686-684 |

In each of these examples, the cladding was the first alloy to solidify and the core alloy was applied to the cladding alloy at a point where a self-supporting surface had formed, but where the surface temperature was still within the L-S range given above. This may be compared to the example above for brazing sheet where the cladding alloy had a lower melting range than the core alloy, in which case the cladding alloy (the "second alloy") was applied to the self supporting surface of the core alloy (the "first alloy"). Micrographs were taken of the interface between the cladding and the core in the above four casts. The micrographs were taken at 50× magnification. In each image the "cladding" layer appears to the left and the "core" layer to the right.

Figure 16:
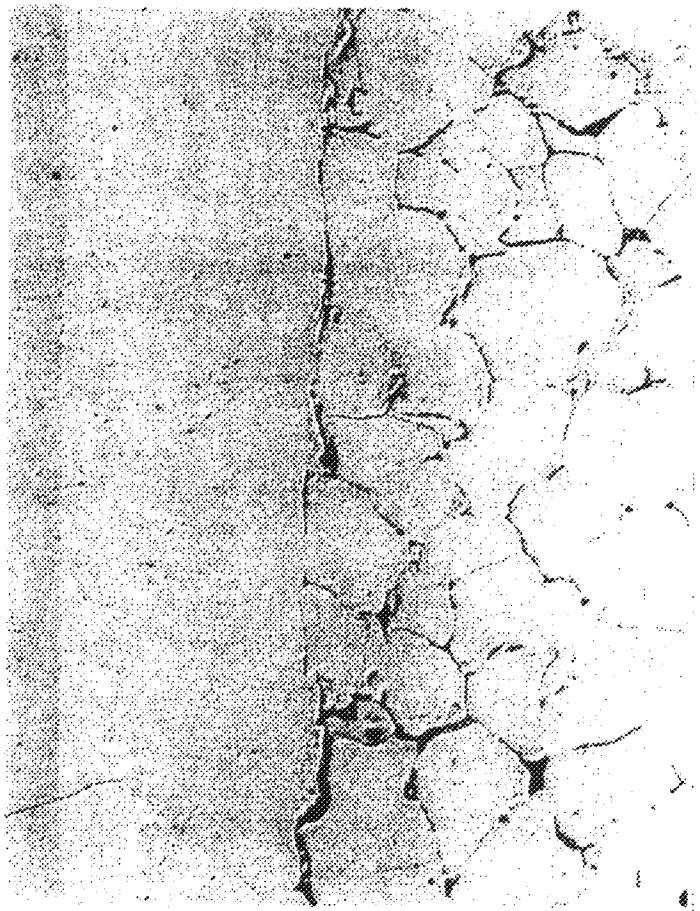
FIG. 16 is a microphotograph of a section through the joining face between a cladding alloy layer and a cast core alloy using the method of the present invention.

FIG. 16 shows the interface of Cast #051804 between cladding alloy 0303 and core alloy 3104. The interface is clear from the change in grain structure in passing from the cladding material to the relatively more alloyed core layer.

Figure 17:
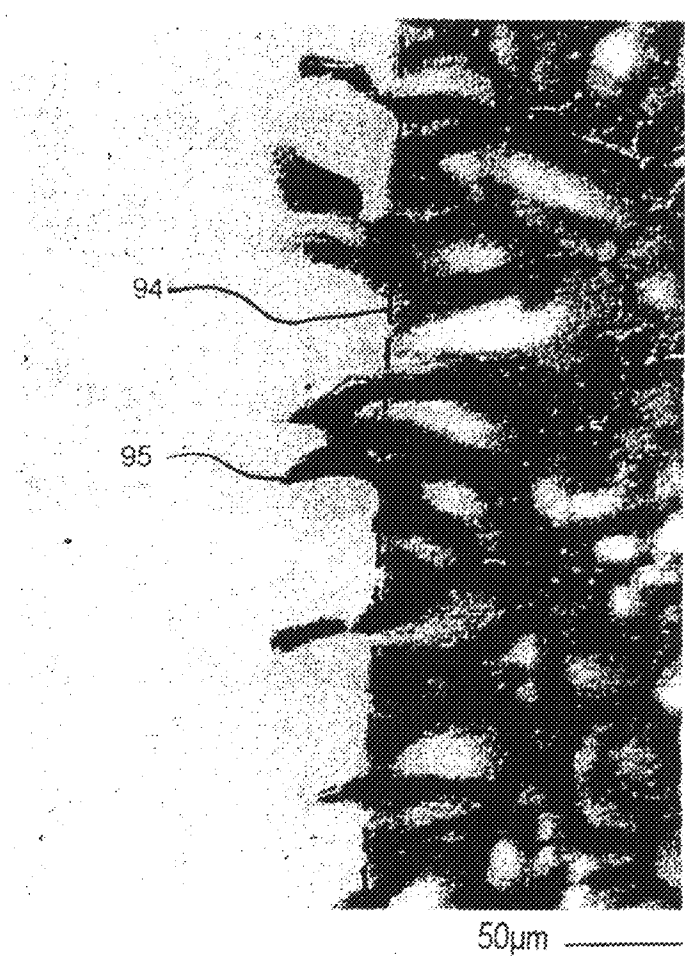
FIG. 17 is a microphotograph of a section through the joining face between a cladding alloy layer and a cast core alloy using the method of the present invention, and illustrating the presence of components of core alloy solely along grain boundaries of the cladding alloy at the joining face.

FIG. 17 shows the interface of Cast #030826 between cladding alloy 1200 and core alloy 2124. The interface between the layers is shown by the dotted line 94 in the Figure. In this figure, the presence of alloy components of the 2124 alloy are present in the grain boundaries of the 1200 alloy within a short distance of the interface. These appear as spaced "fingers" of material in the Figure, one of which is illustrated by the numeral 95. It can be seen that the 2124 alloy components extend for a distance of about 50 μm, which typically corresponds to a single grain of the 1200 alloy under these conditions.

Figure 19:
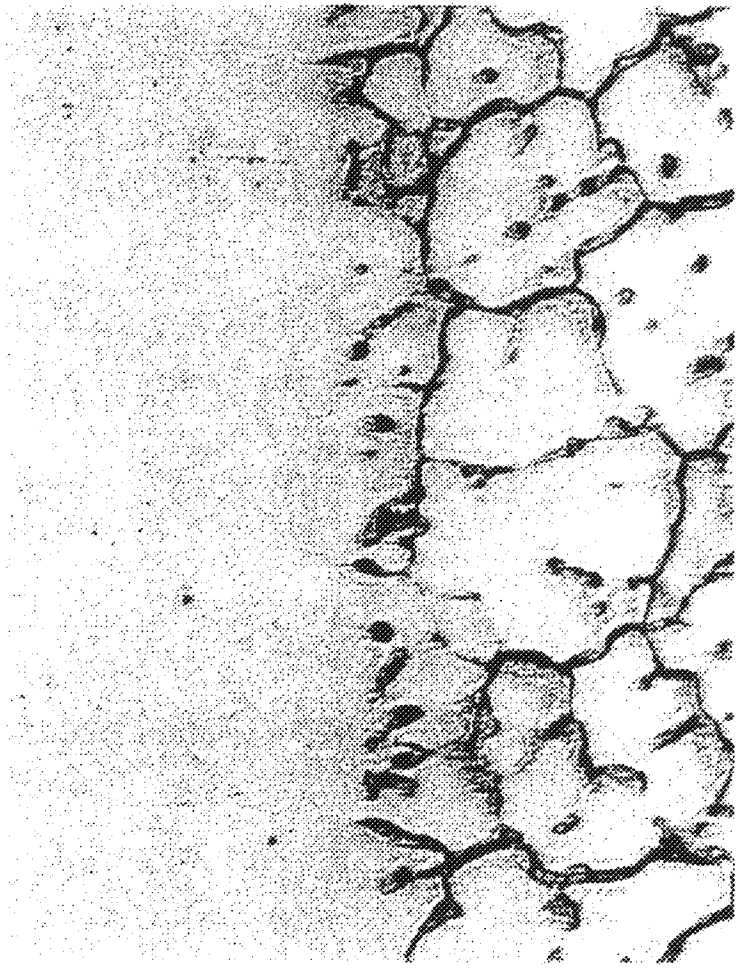
FIG. 19 a microphotograph of a section through the joining face between a cladding alloy layer and a cast core alloy using the method of the present invention, and also illustrating the presence of diffused alloy components as in FIG. 17.
Figure 18:
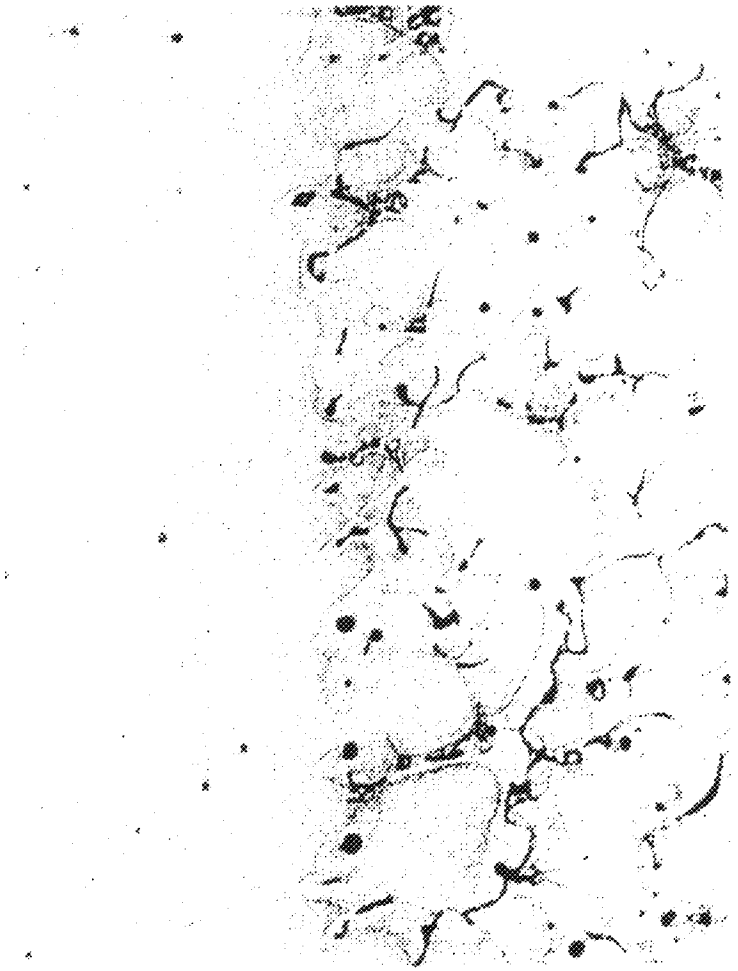
FIG. 18 is a microphotograph of a section through the joining face between a cladding alloy layer and a cast core alloy using the method of the present invention, and illustrating the presence of diffused alloy components as in FIG. 17.

FIG. 18 shows the interface of Cast #031013 between cladding alloy 0505 and core alloy 6082 and FIG. 19 shows the interface of Cast #030827 between cladding alloy 1050and core alloy 6111. In each of these Figures the presence of alloy components of the core alloy are gain visible in the grain boundaries of the cladding alloy immediately adjacent the interface.

What is claimed is:

1. Casting apparatus for the production of composite metal ingots, comprising an open ended annular mould having a feed end and an exit end and a moveable bottom block adapted to fit within the exit end and movable in a casting direction along the axis of the annular mould, wherein the feed end of the mould is divided into at least two separate feed chambers, each feed chamber being adjacent at least one other feed chamber, and where adjacent pairs of feed chambers are separated by a divider wall terminating above the exit end of the mould and fixed in the apparatus against vertical movement relative to said exit end as said bottom block moves in said casting direction, wherein the divider wall is flexible and there is provided one or more linear actuators and control arms attached to the divider wall to permit the shape of the divider wall to be varied during a casting operation.

2. The casting apparatus of claim 1, wherein said one or more control arms is or are attached at one end to a top end of the divider wall.

3. The casting apparatus of claim 2, wherein said one or more control arms is or are driven in a horizontal direction by said one or more linear actuators.

4. The casting apparatus of claim 1, wherein said one or more linear actuators is or are protected by a heat shield.

5. The casting apparatus of claim 1, wherein there is a single linear actuator and a single control arm.

6. The casting apparatus of claim 1, wherein said wall has extreme ends that are fixed in place relative to the mould.

7. The casting apparatus of claim 6, wherein said divider wall is flexible over an entire length thereof between said extreme ends.

8. The casting apparatus of claim 1, wherein said divider wall is temperature controlled.

9. Casting apparatus for the production of composite metal ingots, comprising an open ended annular mould having a feed end and an exit end and a moveable bottom block adapted to fit within the exit end and movable in a casting direction along the axis of the annular mould, wherein the feed end of the mould is divided into at least two separate feed chambers, each feed chamber being adjacent at least one other feed chamber, and where adjacent pairs of feed chambers are separated by a divider wall terminating above the exit end of the mould and fixed in the apparatus against vertical movement relative to said exit end as said bottom block moves in said casting direction, wherein the divider wall is flexible and there is provided one or more linear actuators and control arms attached to the divider wall to permit the shape of the divider wall to be varied during a casting operation, and wherein said divider wall is temperature controlled and includes a channel having an inlet and an outlet for delivery and removal of a temperature control fluid to and from said channel.

* * * * *